US005933875A

United States Patent [19]

Hulsebus et al.

[11] Patent Number: 5,933,875

[45] Date of Patent: Aug. 10, 1999

[54] LIFT-OFF TOILET SEAT HINGE

[75] Inventors: Randy K. Hulsebus, Plymouth; Joseph M. Hand, Sheboygan Falls, both of Wis.

[73] Assignee: Bemis Manufacturing Company, Sheboygan Falls, Wis.

[21] Appl. No.: 08/832,495

[22] Filed: Apr. 3, 1997

[51] Int. Cl.[6] ..... A47K 13/12

[52] U.S. Cl. ..... 4/240

[58] Field of Search ..... 4/236, 240, 241

[56] References Cited

U.S. PATENT DOCUMENTS

| | | | |
|---|---|---|---|
| 3,055,015 | 9/1962 | Silverman | 4/240 |
| 3,063,063 | 11/1962 | Brooks | 4/236 |
| 3,471,874 | 10/1969 | Dixon | 4/240 |
| 3,802,000 | 4/1974 | Waldon | 4/236 |
| 4,159,548 | 7/1979 | Hewson | 4/236 |
| 4,326,307 | 4/1982 | Baillie et al. | 4/236 |
| 4,970,731 | 11/1990 | Fait | 4/234 |
| 5,175,891 | 1/1993 | Ohshima et al. | 4/236 |

FOREIGN PATENT DOCUMENTS

| | | | |
|---|---|---|---|
| 2703579 | 10/1994 | France . | |
| 3405350 | 8/1985 | Germany . | |
| 281385 | 6/1952 | Switzerland | 4/240 |
| 291460 | 9/1953 | Switzerland . | |
| 702060 | 1/1954 | United Kingdom | 4/236 |
| 1525567 | 9/1978 | United Kingdom | 4/240 |
| 2280219 | 1/1995 | United Kingdom . | |
| WO 90/15565 | 12/1990 | WIPO | 4/240 |

*Primary Examiner*—Robert M. Fetsuga
*Attorney, Agent, or Firm*—Michael Best & Friedrich LLP

[57] ABSTRACT

A lift-off toilet seat hinge comprising a hinge base member adapted to be mounted on a toilet bowl, a hinge support member adapted to pivotally support a toilet seat, a locking member supported for rotation between a locked position, where the support member is secured to the base member, and an unlocked position, and an indicator for indicating when the locking member is in the locked position. The base member and the locking member include corresponding arcuate projections which engage when the locking member is in the locked position. The indicator includes a pair of engagement surfaces which engage when the locking member is in the locked position. In one embodiment, the engagement surfaces are provided by a projection on the locking member and a first recess and a second recess in the support member, and the projection extends into the first recess when the locking member is in the locked position.

10 Claims, 7 Drawing Sheets

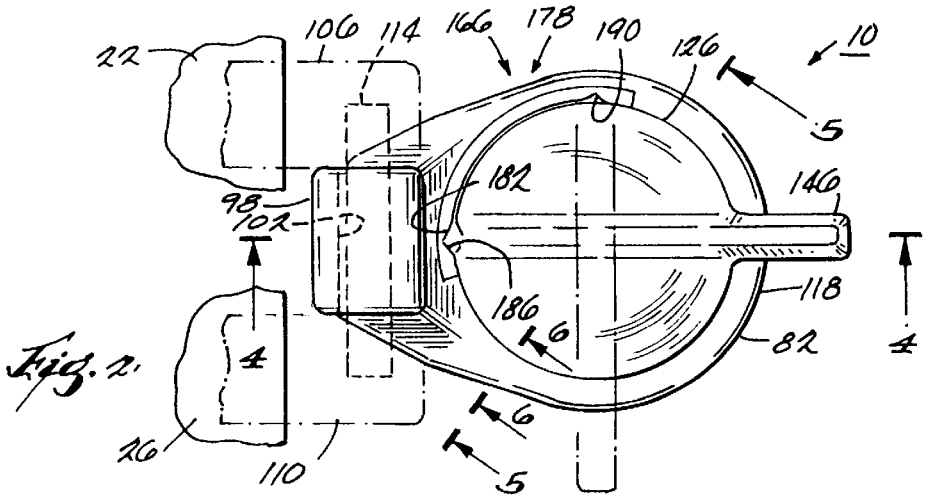
Fig. 2.
Fig. 6
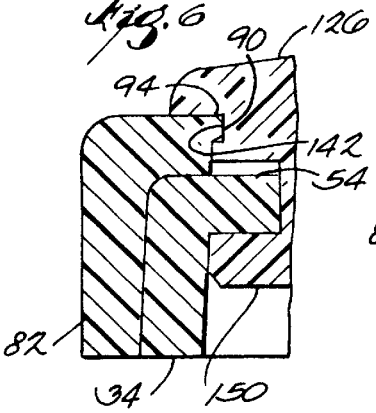
Fig. 3
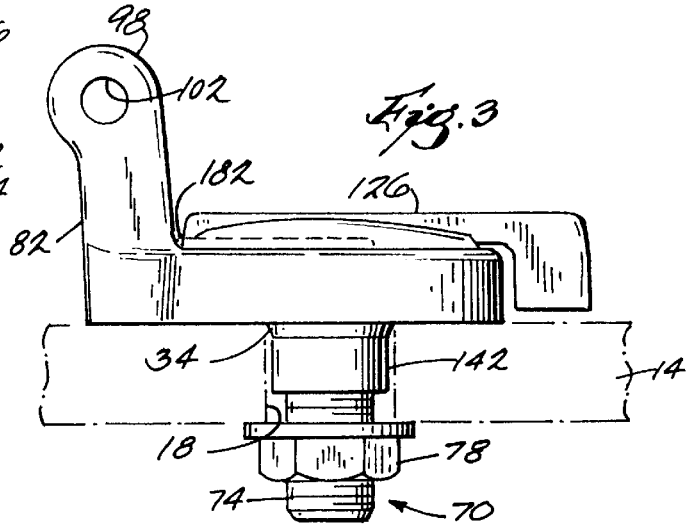
Fig. 4
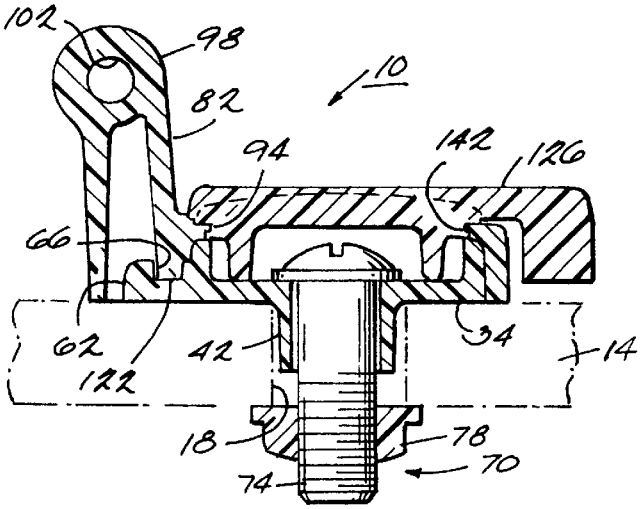

126
54
34
194
142
82
202
198

LIFT-OFF TOILET SEAT HINGE

BACKGROUND OF THE INVENTION

This invention relates to a hinge for detachably securing a toilet seat to a toilet bowl, and more particularly, relates to a toilet seat hinge which securely fastens the toilet seat to the toilet bowl while permitting easy removal of the toilet seat from the toilet bowl, for example, when it is desired to clean the toilet bowl, the toilet seat, or the toilet seat hinge.

Typically, a toilet seat is secured to the flange portion about the top of the toilet bowl by means of hinge posts which are pivotally secured to the rear of the toilet seat. These posts are secured to the toilet bowl by bolts extending through holes in the flange portion of the toilet bowl. This type of toilet seat hinge does not permit the toilet seat to be easily removed from the toilet bowl to facilitate cleaning at the rear of the toilet bowl, particularly around the area between the posts.

Toilet seat securing mechanisms which generally permit detachment of the toilet seat from its secured position on the toilet bowl are known in the art. For example, UK Patent Application GB 2,280,219 discloses a toilet seat hinge comprising a base mounting for attachment to a toilet bowl, a hinge portion having a hinge pin for cooperation with the toilet seat, and a retainer or cap which mounts the hinge portion to the base mounting.

SUMMARY OF THE INVENTION

The invention provides an improved toilet seat hinge which is inexpensive to manufacture and use, is easy to attach and remove, and provides secure fastening of the hinge to the toilet bowl.

More particularly, the invention provides a toilet seat hinge comprising a support member adapted to be mounted on the toilet bowl and to support a toilet seat. A locking member is mounted on the support member for movement between locked and unlocked positions. In the locked position, the locking member secures the support member to the toilet bowl. To assist the user, an indicator indicates when the locking member is in the locked position. In the preferred embodiment, the indicator also indicates when the locking member is in the unlocked position. Preferably, the indicator includes an engagement surface on the support member and an engagement surface on the locking member. These surfaces engage when the locking member is in the locked position. In one embodiment, the indicator includes a detent. The detent includes a projection on the locking member and recesses in the support member. The projection extends into one recess when the locking member is in the locked position and into the other recess when the locking member is in the unlocked position.

The invention also provides a toilet seat hinge comprising a hinge base member adapted to be mounted on a toilet bowl. A fastener secures the base member to the toilet bowl. A hinge support member is adapted to support a toilet seat and includes a top wall having therein an opening. A locking member extends through the opening and is movable between locked and unlocked positions. In the preferred embodiment, the locking member is rotatable between the locked and unlocked positions and secures the support member to the base member in response to rotation to the locked position. Preferably, the base member and the locking member each include a plurality of corresponding arcuate projections which engage when the locking member is rotated to the locked position. The locking member arcuate projections each have an end including a ramp portion for facilitating engagement of the arcuate projections. In one embodiment, the locking member arcuate projections also each have an opposite end including a stop portion for stopping rotational movement of the locking member relative to the base member beyond the locked position.

An advantage of the toilet seat hinge of the present invention is that it is easy to attach and remove. Other prior art toilet seat securing mechanisms, such as that disclosed in UK Patent Application GB 2,280,219, are not as convenient to use due to, for example, the free rotation of the hinge portion and hinge pin within the base mounting and the lack of any indication as to when the hinge portion is properly secured to the toilet bowl.

Other features and advantages of the invention will become apparent to those skilled in the art upon review of the following detailed description, claims and drawings.

DESCRIPTION OF THE DRAWINGS

FIG. 2 is a top view of the toilet seat hinge.

FIG. 3 is a side view of the toilet seat hinge.

FIG. 4 is a cross-sectional view taken along line 4—4 in FIG. 2.

FIG. 6 is a cross-sectional view taken along line 6—6 in FIG. 2.

Figure 7:
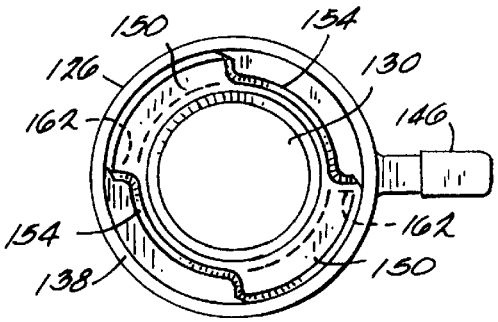
FIG. 7 is a bottom view of the locking member.

Before one embodiment of the invention is explained in detail, it is to be understood that the invention is not limited in its application to the details of the construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting.

DESCRIPTION OF THE PREFERRED EMBODIMENT

Figure 1:
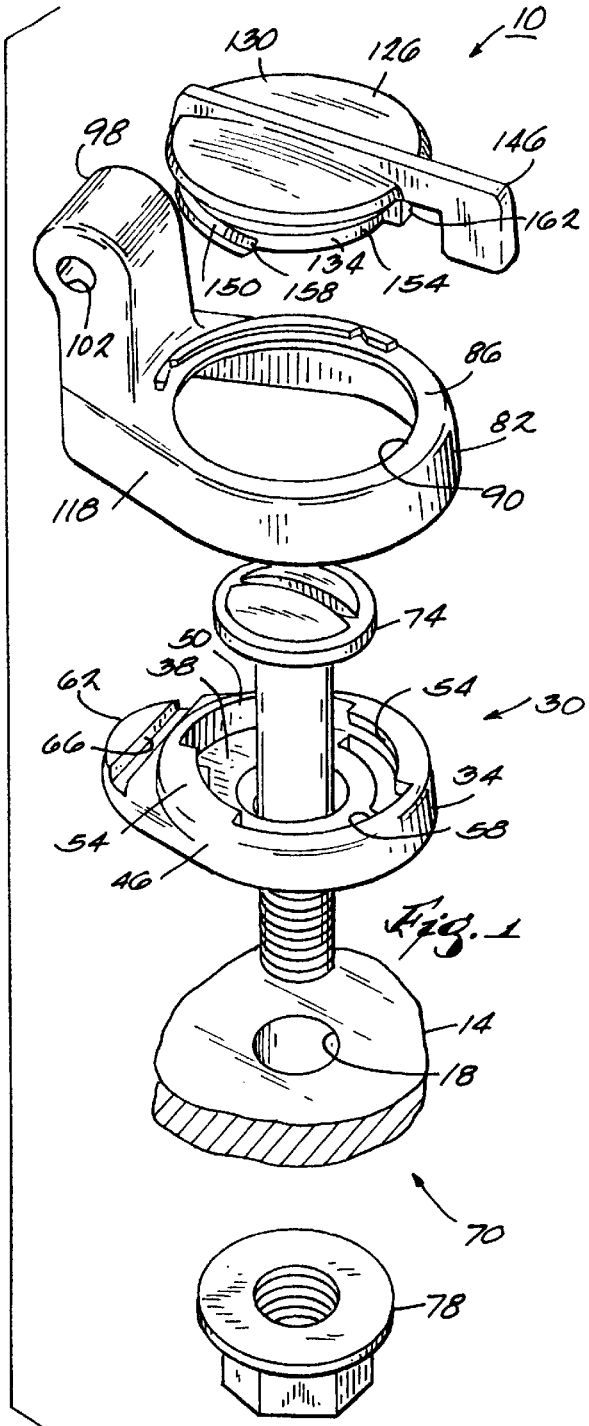
FIG. 1 is a partial exploded perspective view of a toilet embodying the invention.

A toilet 10 embodying the invention is partially illustrated in FIG. 1. The toilet 10 comprises a toilet bowl 14 (partially shown) having a pair of holes 18 (only one shown) through the rear of the flange portion of the toilet bowl 14. The toilet 10 also comprises a toilet seat 22 (partially shown in FIG. 2) and a toilet cover 26 (partially shown in FIG. 2). The toilet 10 further comprises (see FIG. 1) a pair of toilet seat hinges 30 (only one shown) mounted on the toilet bowl 14. The toilet seat hinges 30 pivotally support the toilet seat 22 and the toilet seat cover 26. The toilet seat hinges 30 are substantially identical, and, therefore, only one will be described in detail.

Figure 8:
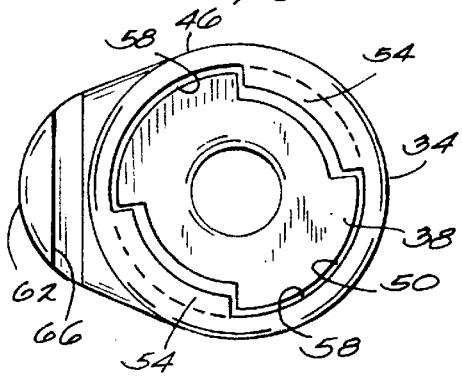
FIG. 8 is a top view of the base member.

The toilet seat hinge 30 includes (see FIGS. 1 and 8) a base member 34 mounted on the flange portion of the toilet bowl 14. The base member 34 includes a bottom wall 38. An annular guide 42 (shown in FIGS. 3–5) extends downwardly from the bottom wall 38. The guide 42 extends into the hole 18 in the toilet bowl 14 when the base member 34 is seated on the toilet bowl 14. The base member 34 also includes (see FIGS. 1 and 8) a non-circular side wall 46. A circular recess 50 is formed by the bottom wall 38 and by the side wall 46. The base member 34 also includes two arcuate projections 54, each of which extends from the inner surface of the side wall 46 and extends less than 90° along the side wall 46. The arcuate projections 54 are positioned in diametrically opposed locations on the side wall 46 and form corresponding gaps 58 of greater than 90°. The base member 34 also includes a forwardly projecting portion 62. A recess or slot 66 is formed in the top surface of the forwardly projecting portion 62.

The toilet seat hinge 30 also includes (see FIGS. 1, 3, and 4) a fastener 70 which secures the base member 34 to the toilet bowl 14. The fastener 70 may be any type known in the art and, in the illustrated construction, includes a bolt 74 and a nut 78. The bolt 74 extends through the guide 42 and through the hole 18. The nut 78 is secured to the bolt 74 beneath the flange portion of the toilet bowl 14.

Figure 5:
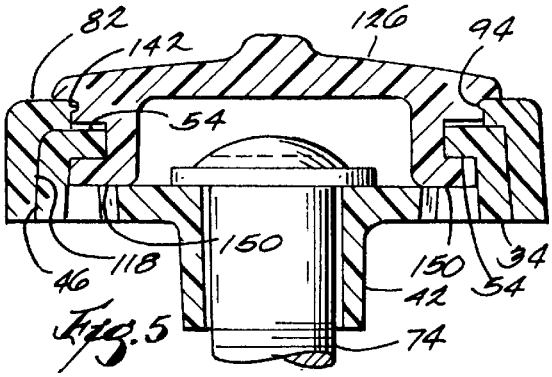
FIG. 5 is a cross-sectional view taken along line 5—5 in FIG. 2.

The toilet seat hinge 30 also includes (see FIGS. 1, 2 and 4) a support member 82 which pivotally supports the toilet seat 22 and the toilet seat cover 26. The support member 82 includes a top wall 86 having therein a circular opening 90. As shown in FIGS. 4–6, the top wall 86 has a narrow portion 94 adjacent the opening 90. The reason for the narrow portion 94 is explained below. The toilet seat 22 and the toilet seat cover 26 can be supported by the supported member 82 in any conventional manner known in the art. In the illustrated construction (see FIGS. 2 and 3), a post 98 extends upwardly from the top wall 86. The post 98 has therethrough a hole 102. A first hinge leaf 106 is connected to the toilet seat 22, and a second hinge leaf 110 is connected to the toilet seat cover 26. A pin 114 extends through the hole 102 in the post 98. The first hinge leaf 106 is connected to one end of the pin 114, and the second hinge leaf 110 is connected to the other end of the pin 114. In this manner, the toilet seat 22 and the toilet seat cover 26 are pivotally connected to the support member 82.

The support member 82 also includes (see FIGS. 1, 4 and 5) a side wall 118. To be properly seated, the support member 82 fits over the base member 34. When the support member 82 is properly seated on the base member 34, a portion of the inner surface of the support member side wall 118 engages a corresponding portion of the outer surface of the base member side wall 46 to prevent rotation of the support member 82 relative to the base member 34. The support member 82 also includes (see FIG. 4) a downwardly extending projection or tab 122 which extends into the slot 66 in the base member 34 to insure that the support member 82 is properly seated on the base member 34 and to prevent the support member 82 from rotating relative to the base member 34.

The toilet seat hinge 30 also includes (see FIGS. 1, 2 and 7) a locking member 126 which is supported by the support member 82 for rotational movement between a locked position (shown in solid lines in FIG. 2) and an unlocked position (shown in dashed lines in FIG. 2), as explained below. The locking member 126 includes (see FIG. 1) a top wall 130 and a side wall 134. A peripheral portion 138 (see FIG. 7) of the top wall 130 extends radially outwardly from the side wall 134. As shown in FIG. 6, the peripheral portion 138 engages the support member top wall 86 about the periphery of the opening 90 when the locking member 126 is seated on the support member 82. As shown in FIGS. 5 and 6, an annular recess 142 is formed in the side wall 134. When the locking member 126 is supported by the support member 82, the narrow portion 94 of the top wall 86 fits into the recess 142 in the side wall 134. In this manner, the locking member 126 is retained by the support member 82 unless manual force is applied to separate the locking member 126 from the support member 82. The locking member 126 also includes (see FIG. 1) a handle 146 to assist the user in rotating the locking member 126 between the locked and unlocked positions.

The locking member 126 also includes (see FIGS. 1 and 7) two locking member arcuate projections 150, each of which extends from the outer surface of the side wall 134 and extends approximately 90° along the side wall 134. The locking member arcuate projections 150 are positioned in diametrically opposed locations on the side wall 134 and form corresponding gaps 154 of approximately 90°. Each arcuate projection 150 has (see FIG. 1) an end which includes a ramp portion 158. Each arcuate projection 150 also has (see FIGS. 1 and 7) an opposite end having a stop portion 162. The purposes for the ramp portion 158 and the stop portion 162, respectively, are explained below.

To seat the locking member 126 on the support member 82, the side wall 134 of the locking member 126 is inserted through the opening 90 in the top wall 86 of the support member 82. The locking member 126 is inserted until the locking member 126 "snaps in" and the narrow portion 94 engages the recess 142. The peripheral portion 138 will engage the top wall 86 of the support member 82 about the periphery of the opening 90.

To seat the locking member 126 and the support member 82 on the base member 34, the locking member 126 is placed in the unlocked position (shown in dashed lines in FIG. 2). The support member 82 is fitted over the base member 34 so that a portion of the inner surface of the support member side wall 118 engages a corresponding portion of the outer surface of the base member side wall 46. Also, the tab 122 extends into the slot 66 in the base member 34. In this position, each locking member arcuate projection 150 is aligned with the corresponding gap 58 in the base member 34. Similarly, each base member arcuate projection 54 is aligned with the corresponding gap 154 in the locking member 126. The side wall 134 of the locking member 126 extends into the recess 50 in the base member 34.

The locking member 126 can then be rotated to the locked position. As the locking member 126 is rotated to the locked position, the locking member arcuate projections 150 engage the base member arcuate projections 54. Each ramp portion 158 facilitates engagement of the arcuate projections 150 and 54. If the locking member 126 is rotated past the locked position, the stop portions 162 will engage an end of the corresponding base member arcuate projection 54 to prevent further rotation.

To release the toilet seat 22 and the toilet seat cover 26 from the toilet bowl 14, for example, for cleaning purposes, the securing process is reversed. The locking member 126 is rotated from the locked position to the unlocked position. The support member 82 and locking member 126 are then removed.

The toilet seat hinge 30 also includes (see FIG. 2) an indicator 166 which indicates when the locking member 126 is in the locked position or the unlocked position. The indicator 166 is provided to assist the user in securing the toilet seat hinge 30 to the toilet bowl 14 so that the toilet seat hinge 30 is not damaged by rotation of the locking member 126 beyond the locked position. The indicator 166 also assists the user by insuring that, when the user intends to "lock" the toilet seat hinge 30, the locking member 126 is not under-rotated so that the toilet seat hinge 30 is not fully secured to the toilet bowl 14.

The indicator 166 includes a detent 178. The detent 178 includes a projection 182 which is formed on the periphery of the top wall 130 of the locking member 126. The detent 178 also includes a first recess 186 which is formed in the support member 82 adjacent the opening 90. The detent 178 also includes a second recess 190 which is also formed in the support member 82 adjacent the opening 90. Alternatively, the projection 182 may be formed on the support member 82 and the recesses 186 and 190 may be formed in the locking member 126. In either case, the projection 182 extends into the first recess 186 to indicate that the locking member 126 is in the locked position and into the second recess 190 to indicate that the locking member 126 is in the unlocked position. Thus, the detent 178 provides the engagement surfaces which engage when the locking member 126 is in the locked position.

A toilet 194 that is a second embodiment of the invention is illustrated in FIGS. 9–16. Except as noted below, the toilet 194 is substantially identical to the toilet 10 illustrated in FIGS. 1–8 and common elements have been given the same reference numerals.

Figure 15:
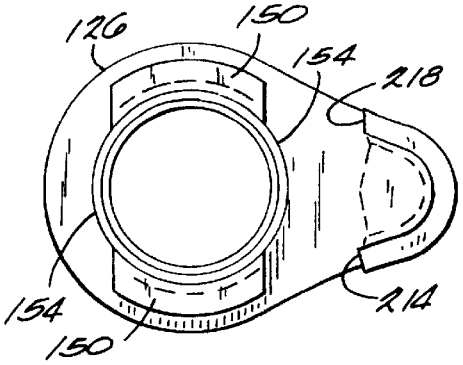
FIG. 15 is a bottom view of the locking member shown in FIG. 9.
Figure 16:
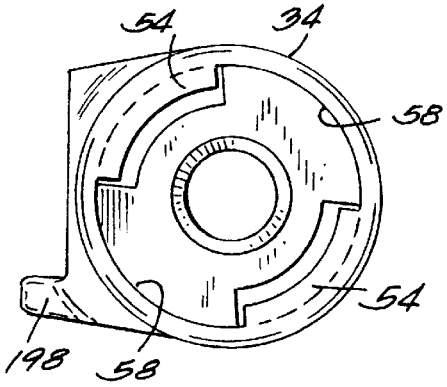
FIG. 16 is a top view of the base member shown in FIG. 9.
Figure 9:
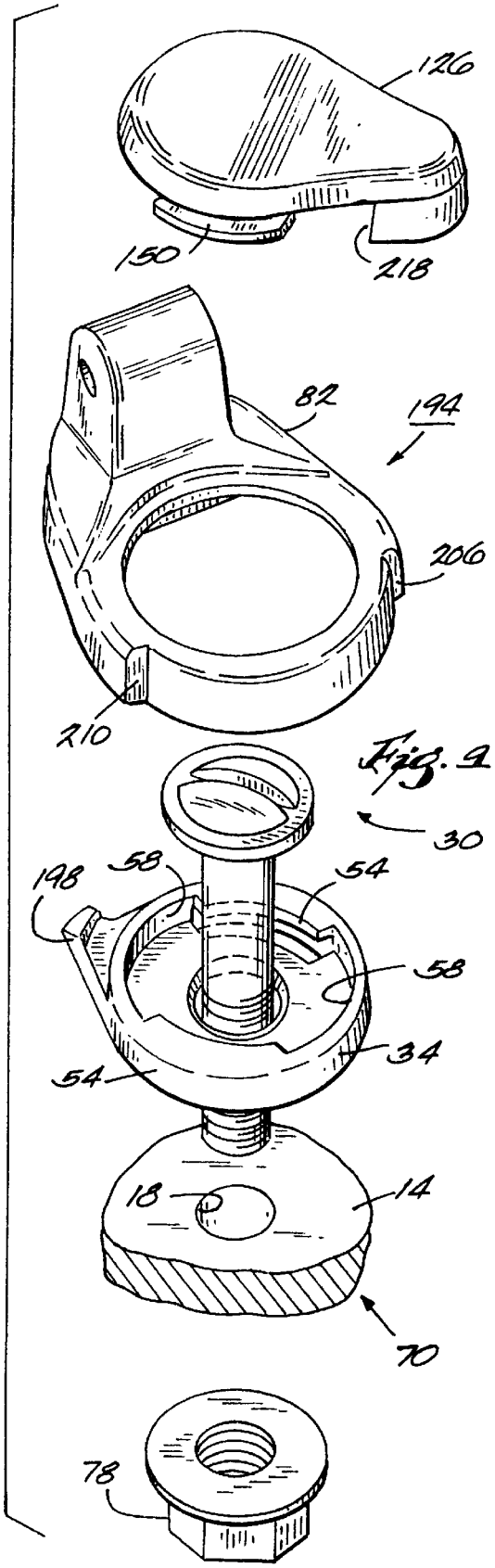
FIG. 9 is a partial exploded perspective view of a toilet that is a second embodiment of the invention.

In the toilet 194, the base member arcuate projections 54 (see FIGS. 9 and 16) are moved approximately 90° with respect to the position illustrated in the first embodiment. Similarly, the gaps 58 are also moved approximately 90°. As shown in FIGS. 9 and 15, the locking member arcuate projections 150 and the corresponding gaps 154 are moved approximately 90° to correspond to position of the base member arcuate projections 54 and the gaps 58 in the base member 34.

Figure 13:
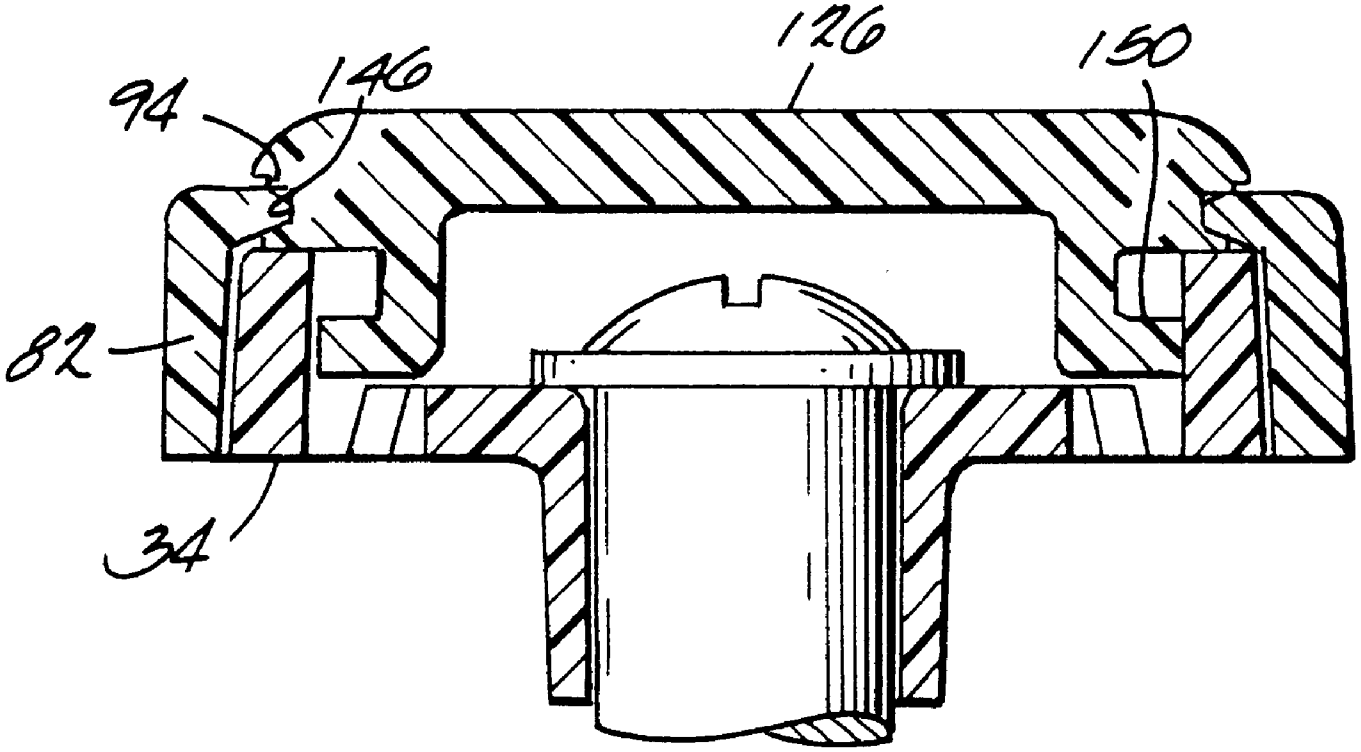
FIG. 13 is a cross-sectional view taken along line 13—13 in FIG. 10.

The base member 34 also includes (see FIGS. 9, 13, and 16) a projection 198. The support member 82 includes (see FIG. 13) a recess 202. As shown in FIG. 13, the projection 198 extends into the recess 202 to insure that the support member 82 is properly seated on the base member 34 and to prevent the support member 82 from rotating relative to the base member 34.

Additionally, the support member 82 includes (see FIGS. 9 and 10) a first stop surface 206 and a second stop surface 210 which are formed on the outer surface of the side wall 110. The purposes for the stop surfaces 206 and 210 are explained below.

Instead of stop portions on the locking member arcuate projections 150, the locking member 126 includes (see FIGS. 10 and 15) a first stop surface 214 and a second stop surface 218 which are formed on the handle 146. The stop surfaces 214 and 218 correspond to the stop surfaces 206 and 210 formed on the support member 82. The first stop surfaces 206 and 214 engage to prevent rotation of the locking member 126 beyond the locked position (shown in dashed lines in FIG. 10). The second stop surfaces 210 and 218 engage to prevent rotation of the locking member 126 beyond the unlocked position (shown in solid lines in FIG. 10).

The engagement surfaces of the indicator 166 are provided by the first stop surfaces 206 and 214. The first stop surfaces 206 and 214 engage to indicate that the locking member 126 is in the locked position (shown in dashed lines in FIG. 10). The indicator 166 also includes the pair of second stop surfaces 210 and 218 which engage to indicate that the locking member 126 is in the unlocked position (shown in FIG. 11 and shown in solid lines in FIG. 10). Thus, the second stop surfaces 210 and 218 provide a second pair of engagement surfaces.

In the toilet 194, the toilet seat 22 and the toilet seat cover 26 are secured to the toilet bowl in substantially the same manner as illustrated in toilet 10. Once the base member 34 is secured to the toilet bowl 14, the locking member 126 is placed in the unlocked position (shown in solid lines in FIG. 10). The support member 82 and the locking member 126 are seated on the base member 34 so that the projection 198 fits into the recess 202. The second stop surfaces 210 and 218 engage to indicate that the locking member 126 is in the unlocked position.

Figure 10:
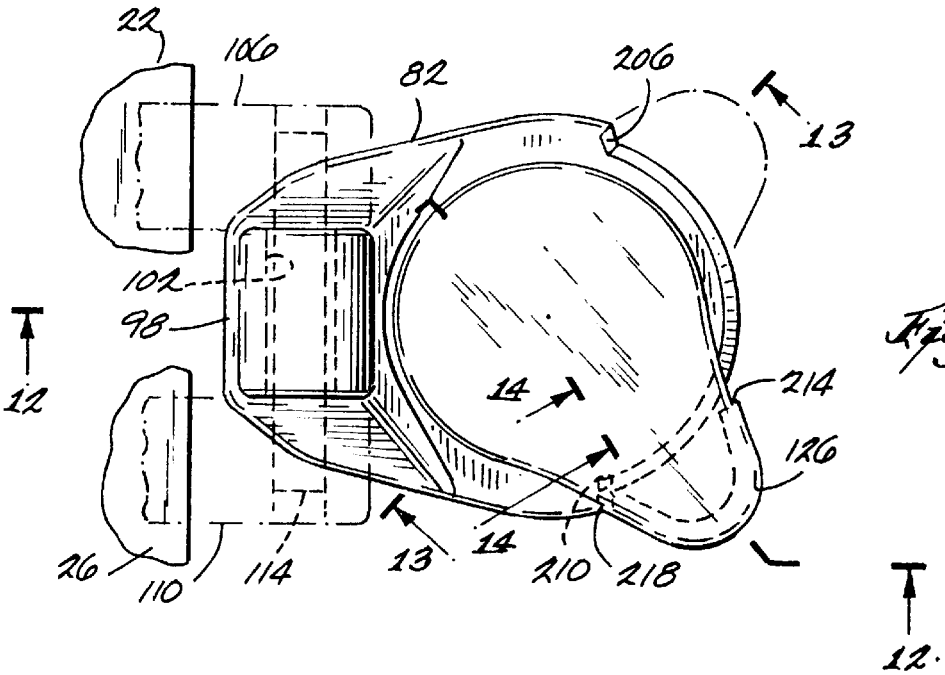
FIG. 10 is a top view of the toilet seat hinge shown in FIG. 9.
Figure 11:
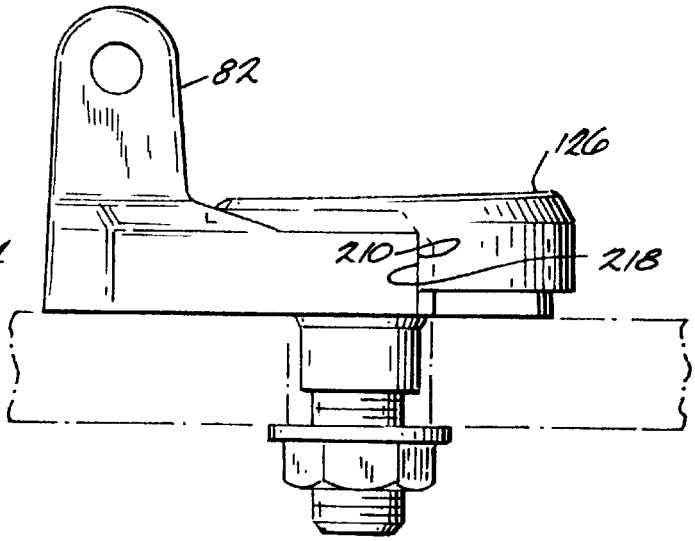
FIG. 11 is a side view of the toilet seat hinge shown in FIG. 9.
Figure 14:
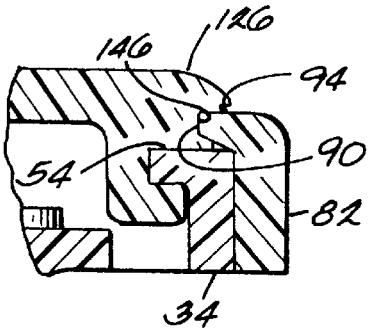
FIG. 14 is a cross-sectional view taken along line 14—14 in FIG. 10.
Figure 12:
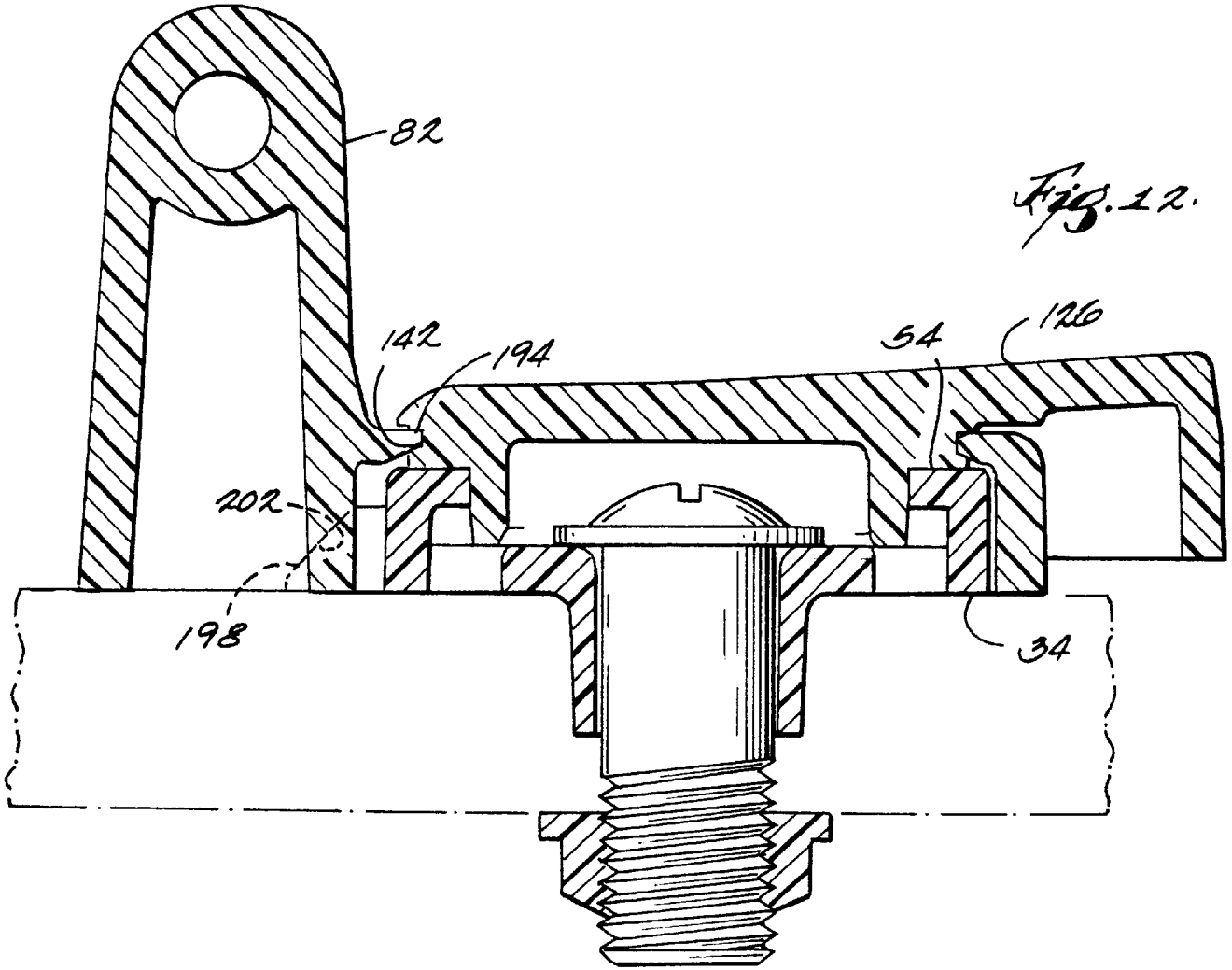
FIG. 12 is a cross-sectional view taken along line 12—12 in FIG. 10.

To secure the support member 82 to the base member 34, the locking member 126 is rotated to the locked position (shown in dashed lines in FIG. 10). The locking member 126 is rotated until the first stop surfaces 206 and 214 engage, indicating the locked position and preventing further rotation. To release the toilet seat 22 and the toilet seat cover 26 from the toilet bowl 14 the securing process is reversed.

Figure 17:
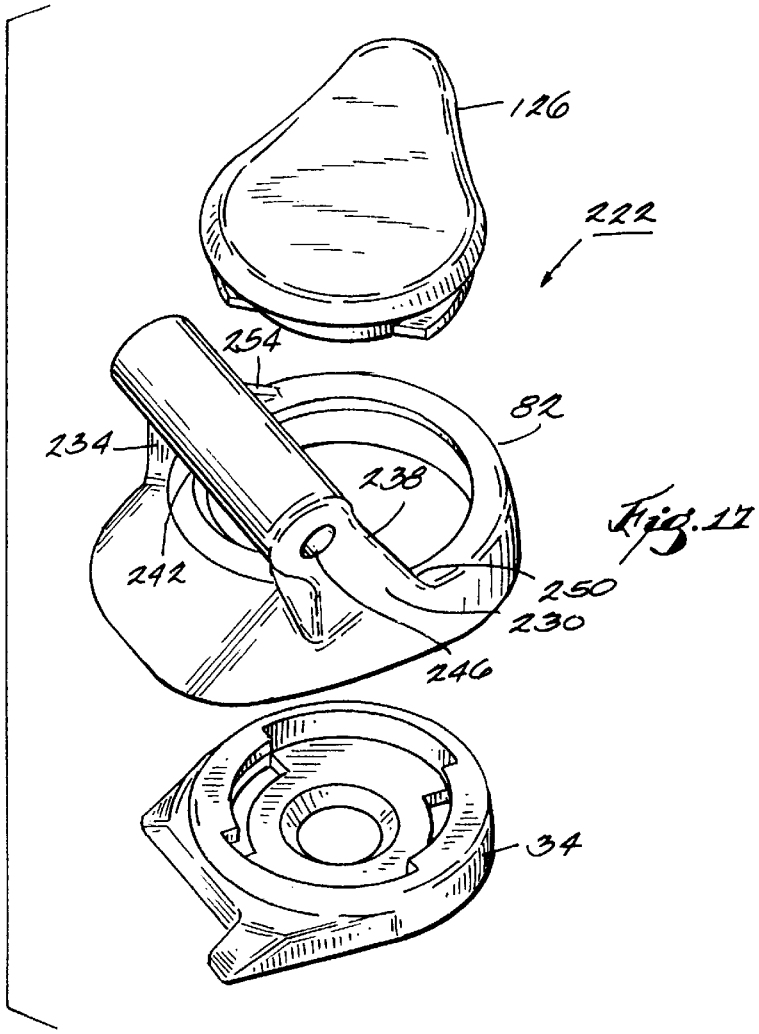
FIG. 17 is a partial exploded perspective view of a toilet that is a third embodiment of the invention.
Figure 18:
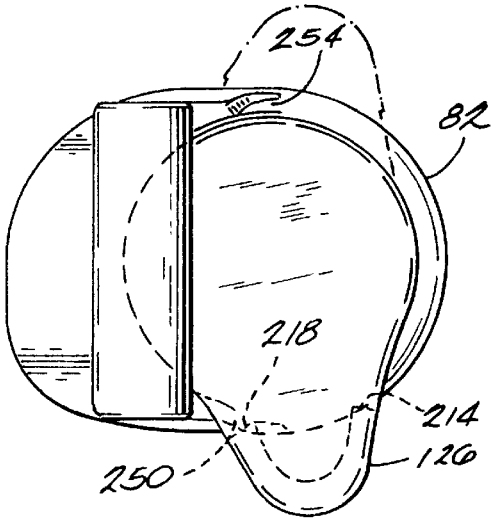
FIG. 18 is a top view of the toilet seat hinge shown in FIG. 17.

A toilet 222 that is a third embodiment of the invention is partially illustrated in FIGS. 17 and 18. Except as noted below, the toilet 222 is substantially identical to the toilet 194 illustrated in FIGS. 9–16 and common elements have been given the same reference numerals.

The support member 82 includes (see FIG. 17) a post 230. The post 230 includes a first post arm 234 and a second post arm 238 which extend at a non-perpendicular angle from the top wall 86. The post 230 also includes a member 242 supported by the post arms 234 and 238. The member 242 has therethrough a hole 246 for supporting the toilet seat 22 and the toilet seat cover 26, in the same manner as illustrated in the first embodiment.

The support member 82 also includes (see FIG. 18) a first stop surface 250 and a second stop surface 254. The first stop surface 250 engages the first stop surface 214 on the locking member 126 to prevent rotation of the locking member 126 beyond the locked position (shown in dashed lines in FIG. 18). The second stop surface 254 engages the second stop surface 218 on the locking member 126 to prevent rotation of the locking member 126 beyond the unlocked position (shown in solid lines in FIG. 18).

Additionally, the engagement surfaces of the indicator 166 are provided by the first stop surfaces 214 and 250. The first stop surfaces 214 and 250 engage to indicate that the locking member 126 is in the locked position (shown in dashed lines in FIG. 18). The indicator 166 includes the pair of second stop surfaces 218 and 254 which engage to indicate that the locking member 126 is in the unlocked position (shown in solid lines in FIG. 18). Thus, the second stop surfaces 218 and 254 provide a second pair of engagement surfaces.

In the toilet 222, the toilet seat 22 and the toilet seat cover 26 are secured to the toilet bowl in substantially the same manner as illustrated in toilet 194. Once the base member 34 is secured to the toilet bowl 14, the locking member 126 is placed in the unlocked position (shown in solid lines in FIGS. 18). The support member 82 and the locking member 126 are seated on the base member 34 so that the projection 198 fits into the recess 202. The second stop surfaces 218 and 254 engage to indicate that the locking member 126 is in the unlocked position.

To secure the support member 82 to the base member 34, the locking member 126 is rotated to the locked position (shown in dashed lines in FIG. 18). The locking member 126 is rotated until the first stop surfaces 214 and 250 engage, indicating the locked position and preventing further rotation. To release the toilet seat 22 and the toilet seat cover 26 from the toilet bowl 14 the securing process is reversed.

Various features of the invention are set forth in the following claims.

We claim:

1. A toilet seat hinge comprising:

a hinge base member adapted to be mounted on a toilet bowl;

a fastener for mounting said base member on the toilet bowl;

a hinge support member adapted to support a toilet seat, said support member including a top wall, said top wall having therein an opening; and a locking member extending through said opening, said locking member being movable between a locked position and an unlocked position, said locking member securing said support member to said base member when said locking member is in the locked position.

2. The toilet seat hinge as set forth in claim 1 wherein said locking member is rotatable between the locked position and the unlocked position, and wherein said locking member secures said support member to said base member in response to rotation of said locking member from the unlocked position to the locked position.

3. The toilet seat hinge as set forth in claim 2 wherein said base member includes a base member arcuate projection, wherein said locking member includes a locking member arcuate projection, and wherein said locking member arcuate projection engages said base member arcuate projection when said locking member is rotated to the locked position.

4. The toilet seat hinge as set forth in claim 3 wherein said base member includes at least one additional base member arcuate projection, wherein said locking member includes at least one additional locking member arcuate projection, each locking member arcuate projection corresponding to a respective one of said base member arcuate projections, and wherein each base member arcuate projection engages the corresponding locking member arcuate projection when said locking member is rotated to the locked position.

5. The toilet seat hinge as set forth in claim 3 wherein said locking member arcuate projection has an end including a ramp portion for facilitating engagement of said locking member arcuate projection and said base member arcuate projection.

6. The toilet seat hinge as set forth in claim 3 wherein said locking member arcuate projection has an end including a stop portion for stopping rotational movement of said locking member relative to said base member beyond the locked position.

7. The toilet seat hinge as set forth in claim 3 wherein said base member includes a base side wall having an inner surface, said base member arcuate projection extending from said inner surface of said base side wall, said base member arcuate projection extending along a portion of said base side wall, wherein said locking member includes a locking member side wall having an outer surface, said locking member arcuate projection extending from said outer surface of said locking member side wall, said locking member arcuate projection extending along a portion of said locking member side wall.

8. The toilet seat hinge as set forth in claim 1 wherein said base member includes a base member side wall having an outer surface, wherein said support member includes a support member side wall depending from said top wall, and wherein said support member side wall engages said base member side wall to prevent rotation of said support member relative to said base member.

9. The toilet seat hinge as set forth in claim 2 wherein one of said base member and said support member includes a recess, wherein the other of said base member and said support member includes a projection, and wherein said projection extends into said recess when said support member is secured to said base member.

10. A toilet comprising:

a toilet bowl;

a toilet seat; and a toilet seat hinge pivotally connecting said seat to said bowl, said hinge including a hinge base member adapted to be mounted on said toilet bowl, said base member including a bottom wall and a base member side wall extending from said bottom wall, said bottom wall and said base member side wall defining a recess, said base member side wall having an inner surface and an outer surface, said base member also including a first base member arcuate projection and a second base member arcuate projection, each base member arcuate projection extending from said inner surface of said base member side wall, each base member arcuate projection extending along a portion of said base member side wall, a hinge support member adapted to pivotally support said seat, said support member being removably supported by said base member, said support member including a top wall having therein an opening, said support member also including a support member side wall depending from said top wall, said support member side wall having an inner surface engaging said outer surface of said base member side wall to prevent rotation of said support member relative to said base member, one of said base member and said support member having a recess, the other of said base member and said support member including a projection, and said projection extending into said recess when said support member is supported by said base member, a locking member rotatably supported by said support member, said locking member being rotatable between a locked position and an unlocked position, said locking member securing said support member to said base member when said locking member is in the locked position, said locking member extending through said opening and into said recess, said locking member including a locking member side wall having an outer surface, said locking member also including a first locking member arcuate projection and a second locking member arcuate projection, each locking member arcuate projection extending from said outer surface of said locking member side wall, each locking member arcuate projection extending along a portion of said locking member side wall, wherein said first locking member arcuate projection engages said first base member arcuate projection and said second locking member arcuate projection engages said second base member arcuate projection when said locking member is in the locked position, each locking member arcuate projection having an end including a portion, said portions facilitating engagement of said locking member arcuate projections and said base member arcuate projections as said locking member is rotated to the locked position, and an indicator for alternatively visually indicating when said locking member is in the locked position or the unlocked position, said indicator including an engagement surface on said locking member, said indicator also including an engagement surface on said support member, wherein said engagement surfaces engage when said locking member is in the locked position.

* * * * *